United States Patent [19]

Seragnoli

[11] 4,056,915

[45] Nov. 8, 1977

[54] COMPENSATING STORE DEVICE IN SYSTEMS FOR DIRECTLY FEEDING CIGARETTES FROM CIGARETTE MANUFACTURING MACHINE OR MACHINES TO THE HOPPER OF THE CIGARETTE PACKETING MACHINE

[75] Inventor: Enzo Seragnoli, Bologna, Italy

[73] Assignee: G. D. Societa per Azioni, Italy

[21] Appl. No.: 651,332

[22] Filed: Jan. 22, 1976

[30] Foreign Application Priority Data

Jan. 29, 1975 Italy ..... 3323/75

[51] Int. Cl.[2] ..... B65B 57/14

[52] U.S. Cl. ..... 53/59 R

[58] Field of Search ..... 53/59 R, 148; 198/20 C, 198/37, 20 R, 103, 347; 214/6 TS; 131/25; 221/79, 81, 103, 105

[56] References Cited

U.S. PATENT DOCUMENTS

| | | | |
|---|---|---|---|
| 3,499,555 | 3/1970 | Wahle | 198/347 |
| 3,782,523 | 1/1974 | Giatti | 198/347 |

*Primary Examiner*—Othell M. Simpson

*Assistant Examiner*—John Sipos

*Attorney, Agent, or Firm*—Robert E. Burns; Emmanuel J. Lobato; Bruce L. Adams

[57] ABSTRACT

A compensating store device for cigarettes, between cigarette manufacturing machines and machines for packeting the cigarettes, wrapping the packets and making and wrapping packs of wrapped packets. The store device comprises a cylinder rotating about a vertical axis and having vertical, radial cigarette storage compartments, circumferentially distributed. A cigarette delivery channel at the top of this cylinder feeds cigarettes from a feeding conveyor run to the compartments, and tilts gradually so as not to loose its free and open, cigarette-feeding connection to the compartment in the rotating cylinder. Similarly, a cigarette-removing channel at the bottom of the cylinder is tiltably mounted. Between these channels, successive, horizontal rods are moved into, downwardly along, and ultimately from each compartment, with the aid of a further tilting mechanism, to provide supports for the cigarettes stored in the compartments. The channels have gates which are operable as additional cigarette support or stop means.

10 Claims, 11 Drawing Figures

Fig. 6
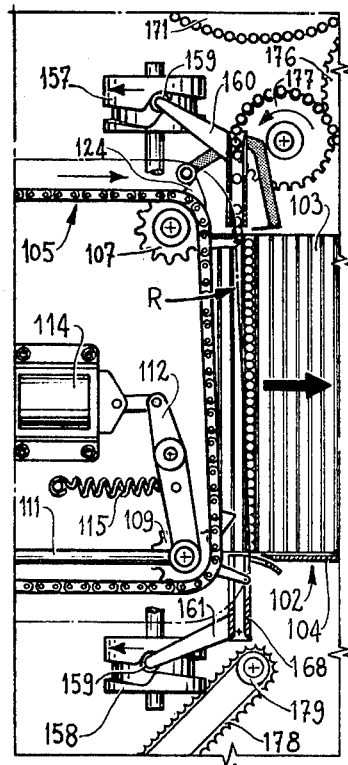
Fig. 7
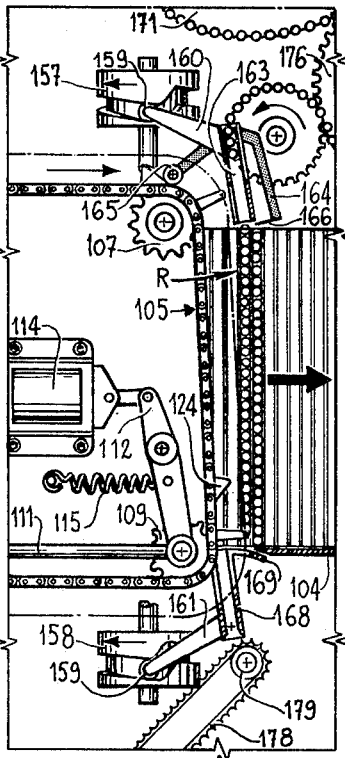
Fig. 8
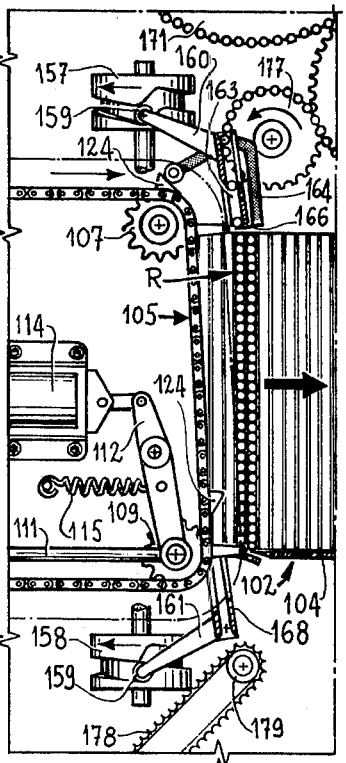
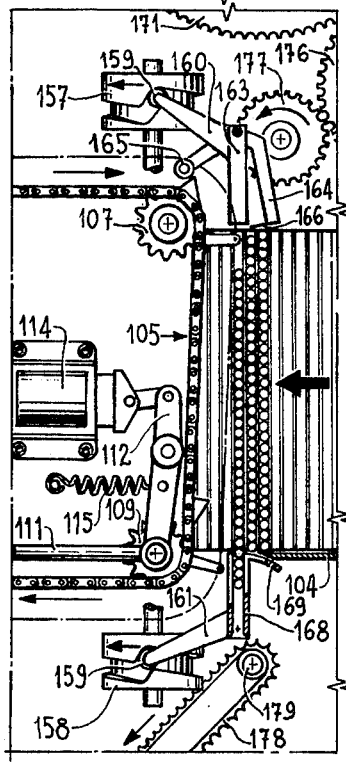
Fig. 9
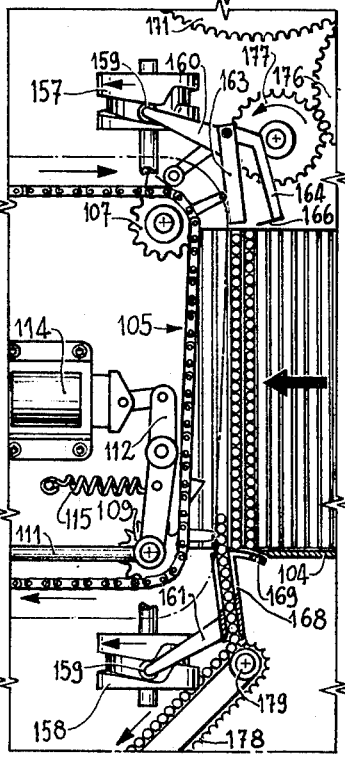
Fig. 10
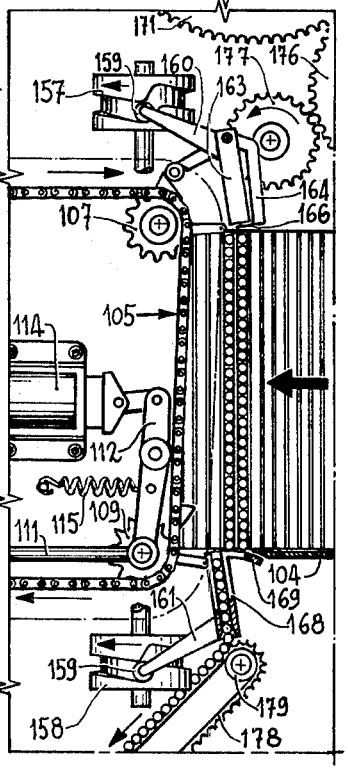
Fig. 11

COMPENSATING STORE DEVICE IN SYSTEMS FOR DIRECTLY FEEDING CIGARETTES FROM CIGARETTE MANUFACTURING MACHINE OR MACHINES TO THE HOPPER OF THE CIGARETTE PACKETING MACHINE

CROSS REFERENCE TO OTHER APPLICATIONS

This application is related to U.S. patent applications Ser. No. 651,334 and Ser. No. 651,335 both filed on Jan. 22, 1976.

BACKGROUND OF THE INVENTION

The present invention relates to a compensating store device to be used in systems for directly feeding cigarettes from cigarette manufacturing machines to the hopper of a cigarette packeting machine.

As known, the plants in use at present for producing cigarettes comprise two different types of machine, i.e.:

1. Machines for producing cigarettes from cut and cured tobacco leaves, usually called cigarette manufacturing machines, and 2. Cigarette packaging machines.

The machines of the second type usually comprise:

Machines for producing packets of cigarettes, usually called packeting machines;

Machines for producing packs of cigarette packets, usually called packing or packforming machines, and Wrapping machines for wrapping either single packets of cigarettes, called cellophaning machines, or single packs of cigarette packets, usually called "over wrapping machines".

In said plants, the cellophaning machines are located between the packeting machines and the packing or pack-forming machines, while the "over wrapping machines" are located downstream of or after the packing or packforming machines.

It is also known that there exist in practice various types of cigarette manufacturing machine operating at a respective output speed of 2000 to 4000 cigarettes per minute.

There also exist various types of manufacturing machines operating at output speeds ranging from 100–120 up to 400 packets of cigarettes/ minute, whereas the output speed of the packing or pack-forming machines is a function of the number of packets forming the single packs. Among the wrapping machines for wrapping single cigarette packets, the type of cellophaning machine of the Applicant's assignees, which can wrap 400 packets of cigarettes per minute, is widely used. To wrap single packs, "over wrapping machines" operating at the same output speed as that of the packeting or packing machines co-operating therewith, are usually employed.

When considering the output speeds of the various types of machines in use at present, it is found that depending on the types of machine used in forming the plant, a packeting machine can absorb the output of one to three manufacturing machines, whereas a cellophaning machine can absorb the output or production of one to three packeting machines. As known, the cigarette supply from the manufacturing machine or machines to the packeting machine may occur substantially in two different ways, i.e.:

a. either by unloading the cigarettes into containers at the outlet of the cigarette manufacturing machine or machines, the containers being then transferred and unloaded into the assembling or grouping hopper arranged to feed the packeting line of the packeting machine, or b. by directly connecting such outlet of the cigarette manufacturing machine or machines to the grouping hopper arranged to feed the packeting line of the packeting machine.

The present invention concerns the latter branch of the art, in which the outlet of the manufacturing machine or machines is directly connected to the grouping hopper of the packeting machine.

For such type of feeding system, it was already suggested to convey the cigarettes in a continuous or uniform flow from the manufacturing machine or machines to the packeting machine, the cigarettes, while being fed, being arranged in a succession of single cigarettes or batches of cigarettes by providing along the cigarette path means arranged to permit variations in the feeding flow as a function of the variations in the delivery capacity of the manufacturing machine or machines and of the receiving capacity of the packeting machine, respectively, so as to compensate for the frequently occurring unbalances in the output of said machines.

According to the proposals known at present, said means arranged to permit volume variations in the cigarette flow as a function of the variations of the delivery capacity and the receiving capacity of said machines are provided, conceived and designed as having structures enabling them to act on batches of cigarettes, in contact with each other inside or outside the grouping hopper of the packeting machine.

On such batchwise treating of the cigarettes, piled up during both the simple transfer stages and particularly the piling up stages in order to compensate for frequently occurring unbalances in the output of the operating machines, the cigarettes are subjected to stress. This inevitably results, already in this initial stage of the process, in a damage to the cigarettes, in particular to the structural characteristics thereof (loss of compactness in the tobacco inside the cigarette envelope or paper).

For such reasons systems have been proposed for the direct feeding system mentioned in paragraph b above, in which various transfer means and even means arranged to permit changes in the flow rate act on single cigarettes rather than on cigarette batches. In order to eliminate the drawbacks due to direct connection between machines running at different operating speeds, such systems have used a compensating store device for compensating for unbalances which may occur owing to such different operating speeds, the cigarettes being stored one by one in the store and being withdrawn therefrom still one by one in case of need.

For instance, a device having a substantially cylindrical body which is about equal in height to the length of a cigarette and comprising radial compartments all around it, the compartments being about equal in width to the diameter of a cigarette and variable in depth, and being arranged to contain piles of cigarettes extending parallel to the axis of said cylindrical body, is already known. Such a device is continuously rotated about its own axis and its compartments, the depth of which uniformly increases or decreases depending on whether a storing or withdrawal operation is being performed, successively reach a well determined position, where during each 360° rotation every compartment receives a cigarette in the first operating condition thereof and delivers it in the second condition.

It should be noted that in view of this, such storing and withdrawing operations are carried out by following a spiral-like course.

From the above, it should appear that the maximum amount of cigarettes which can be stored is proportional to the diameter of the cylindrical body and this means that precise limits exist for the capacity and thus for the utility of such device.

Such compensating store is in fact subject to both size and weight limitations, the weight limitations being due to the fact that the speed of rotation of a particular storing and withdrawing mechanism has necessarily to match with the high output speed of the machines co-operating therewith.

It should also be both noted that the cigarettes located in the innermost turns of said spiral will be only seldom withdrawn and this might be deleterious to the structural characteristics thereof.

SUMMARY OF THE INVENTION

The main object of the present invention is to obviate all the above-mentioned drawbacks by providing a feeding system acting on single cigarettes, with a compensating store device of large capacity and relatively small dimensions, and of particularly simple structure.

Another object of the present invention is to provide a compensating store device capable of attaining the abovementioned objects and having such a structure that it is possible to begin the cigarette withdrawing operation by starting from the cigarettes first stored.

These and still further objects are all attained by the compensating store device according to the invention for compensating unbalances occurring in the output of cigarette producing plants in which the cigarettes are directly fed from the manufacturing machine or machines to the grouping hopper arranged to feed the wrapping line of the packeting machine. The new device uses a cylindrical body having radial cigarette-storing compartments and arranged to rotate continuously about its own axis to carry successive radial storing compartments past means for delivering and withdrawing horizontally arranged cigarettes. According to the invention the cylindrical body, with its axis of rotation extending vertically, has a drive mechanism, advantageously comprising a bidirectional motion source, operable to vertically align successive radial storing compartments below a delivery channel station and above a vertically overlying withdrawing channel station for the cigarettes. A conveyor chain or the like moves a plurality of horizontally cantilevering rods, spaced from each other in a downward motion slightly inclined in accordance with the continuous rotation of the cylinder. This chain cooperates with a drive mechanism by means of a removably mounted drive device located upstream of a motion direction transformer for the bidirectional drive to carry successive ones of said rods, normal to said vertical rotational axis, unidirectionally into, along and from the radial storing compartment then aligned with said channel stations so as to support the cigarettes in said radial storing compartment and to permit their being ultimately withdrawn therefrom. mobile intercepting members are in delivery and withdrawl channels arranged so long as required to stop the cigarette flow in synchronism with each successive radial storing compartment passing the location of said channel stations and are also arranged to normally, gradually follow the continuous motion of the cylinder.

BRIEF DESCRIPTION OF THE DRAWINGS

Further characteristics and advantages will better appear from the following detailed description of a preferred but not-exclusive embodiment of the device or apparatus according to the invention, illustrated only by way of nonlimiting example in the accompanying drawings, in which:

FIGS. 6, 7, 8 are side views taken from the same side of the device according to the invention while operating in a first operating condition.

FIG. 9, 10, 11 are side views taken from the same side of the device according to the invention, while operating in a second operating condition.

DESCRIPTION OF THE PREFERRED EMBODIMENT

Figure 1:
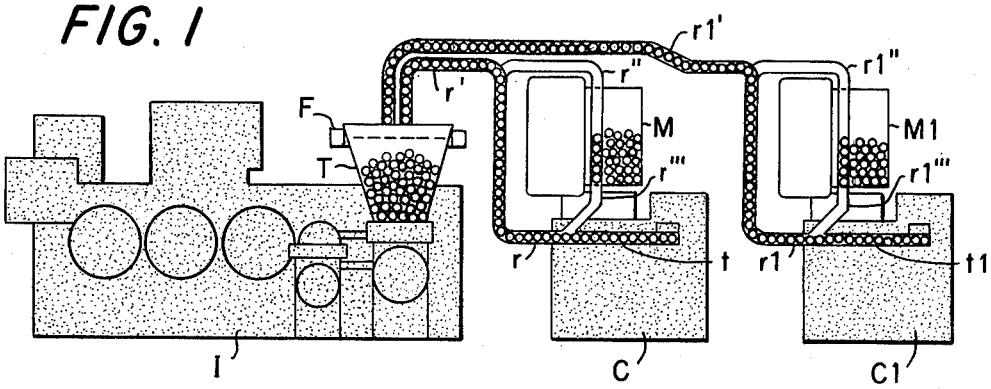
FIGS. 1, 2, 3, 4 diagrammatically show four possible ways of operation of a plant in accordance with patent application Ser. No. 651,345 the same Applicant and including a compensating store device according to the present invention.
Figure 2:
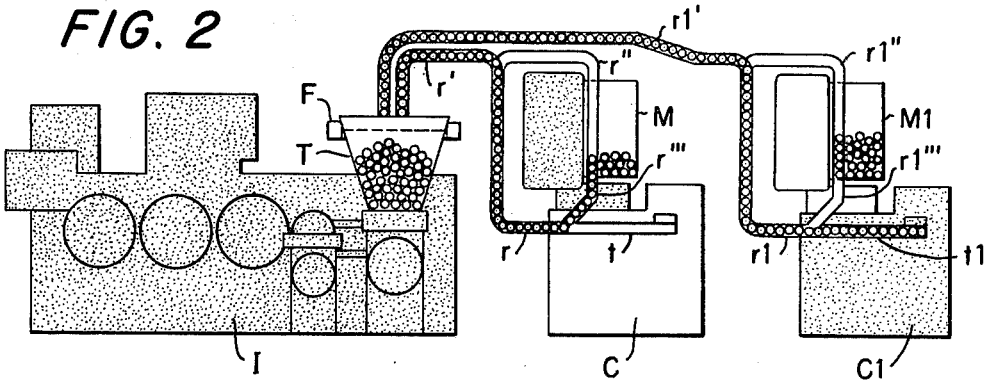
Figure 3:
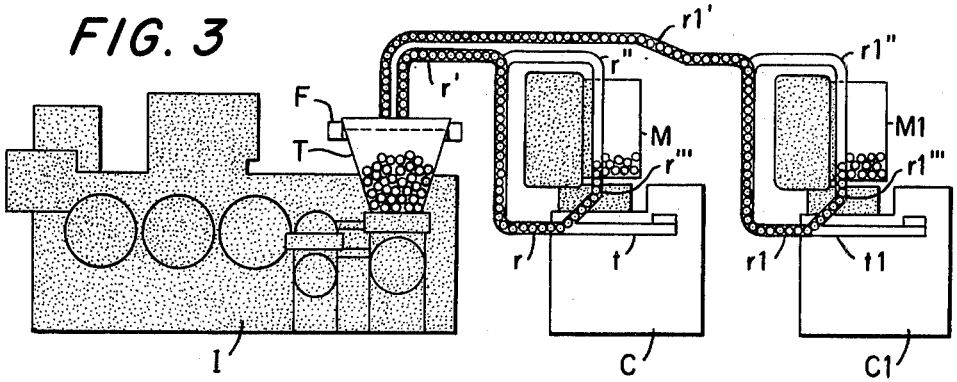
Figure 4:
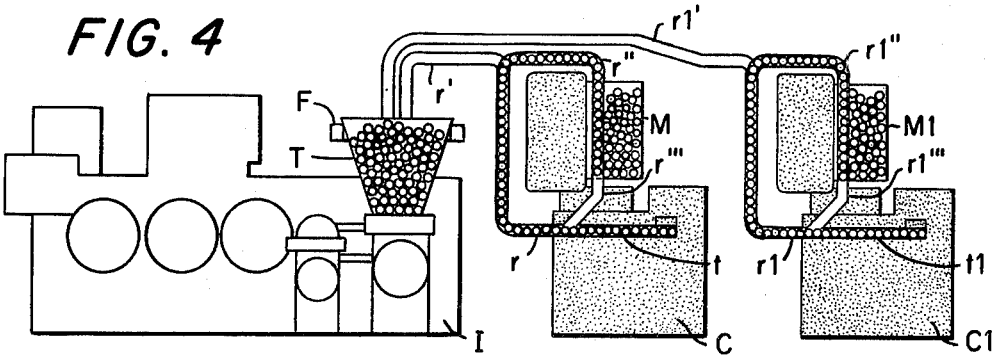

As shown in FIGS. 1, 2, 3, 4 the direct feeding system according to the above-mentioned Patent Application comprises: a packeting machine I operating at a high unitary output speed, of the type known on the market under the name X1, which is produced by the Applicants assignees, G. D. SOCIETA' PER AZIONI, said packeting machine producing 400 packets of cigarettes per minute of the so-called soft or American type, each packet containing about twenty cigarettes; two cigarette manufacturing machines C and C1 also of a known type, each of which operates at an output speed of about 4000 cigarettes per minute; and two compensating store devices B according to the present invention, respectively co-operating with the machine C and the machine C1 and schematically shown at M and M1 respectively.

As known, the packeting machine I comprises a grouping or assembling hopper T arranged to feed groups of cigarettes to the packeting line which is a part of the same machine, and a device F of any known type, such as a photocell, arranged to detect the reaching of a predetermined maximum level of the cigarettes in the hopper T and to control cigarette switching means, not shown in the drawings, for example of the type disclosed in the patent application Ser. No. 651,346 in the name of the same Applicant, when the packeting machine I stops.

The manufacturing machines C and C1 are of the type comprising a continuous conveying device *t* and ***t*1**, respectively, such as an endless belt, arranged to transfer a continuous succession of cigarettes transversely arranged with respect to the conveying or transfer direction from the outlet of the corresponding manufacturing machine to further conveying devices.

Each of the latter conveying devices is of a continuous type and arranged to act on single cigarettes. It comprises for example preferably grooved wheels or drums or mutually opposed belts. It has a first ascending run or section, more precisely the run *r* which is an extension of the conveyor *t*, and the run or section ***r*1 which is an extension of the conveyor *t*1**. Finally run *r* has, as extensions thereof, two sections or runs *r'*, *4''* diverging from one another, while run *r1* has two sections or runs *r1'*, *r1''* which are extensions of that run.

The two extensions *r'* and *r1'* open into the hopper T, whereas the two extensions *r''* and *r1''* open into the device M or the device M1, respectively, in accordance with the present invention.

Said device M and M1 are also connected respectively to the conveying devices *t* and *t1*, by continuous conveyor runs or sections *r''' and r1'''*.

It will be seen that the runs and extensions *r, r'', r'''(r1, r1'', r1''')* of the compensating store device M' (M') are arranged to provide a complete cycle or circuit, wherein extension *r''* feeds cigarettes to the device, and run *r'''* withdraws cigarettes from the device.

A plant of the type briefly described above which comprises compensating store devices according to the present invention arranged to compensate for frequently occurring unbalances in the output of the operating machines which are due to the manufacturing machine stops or shutdowns more frequent than those of the packeting machine, can operate according to the following different operating conditions:

A. The packeting machine I and the manufacturing machines C and C1 are running and the compensating store devices M and M1 are stationary (see FIG. 1);

B. The packeting machine I and one of the two manufacturing machines are running, while the other manufacturing machine is stationary and the compensating store device of the latter is running in a feeding or supplying condition or stage (see FIG. 2, where the machine C is stationary and its compensating store device M is running in a feeding or supplying stage or condition);

C. The packeting machine I is running, the manufacturing machines C and C1 are stationary and the compensating store devices M and M1 are in a feeding stage (see FIG. 3);

D. The packeting machine I is stationary and at least one manufacturing machine with its compensating store device is being supplied or fed (see FIG. 4, where both manufacturing machines C and C1 are running and both compensating store devices M and M1 are being supplied or fed).

Figure 5:
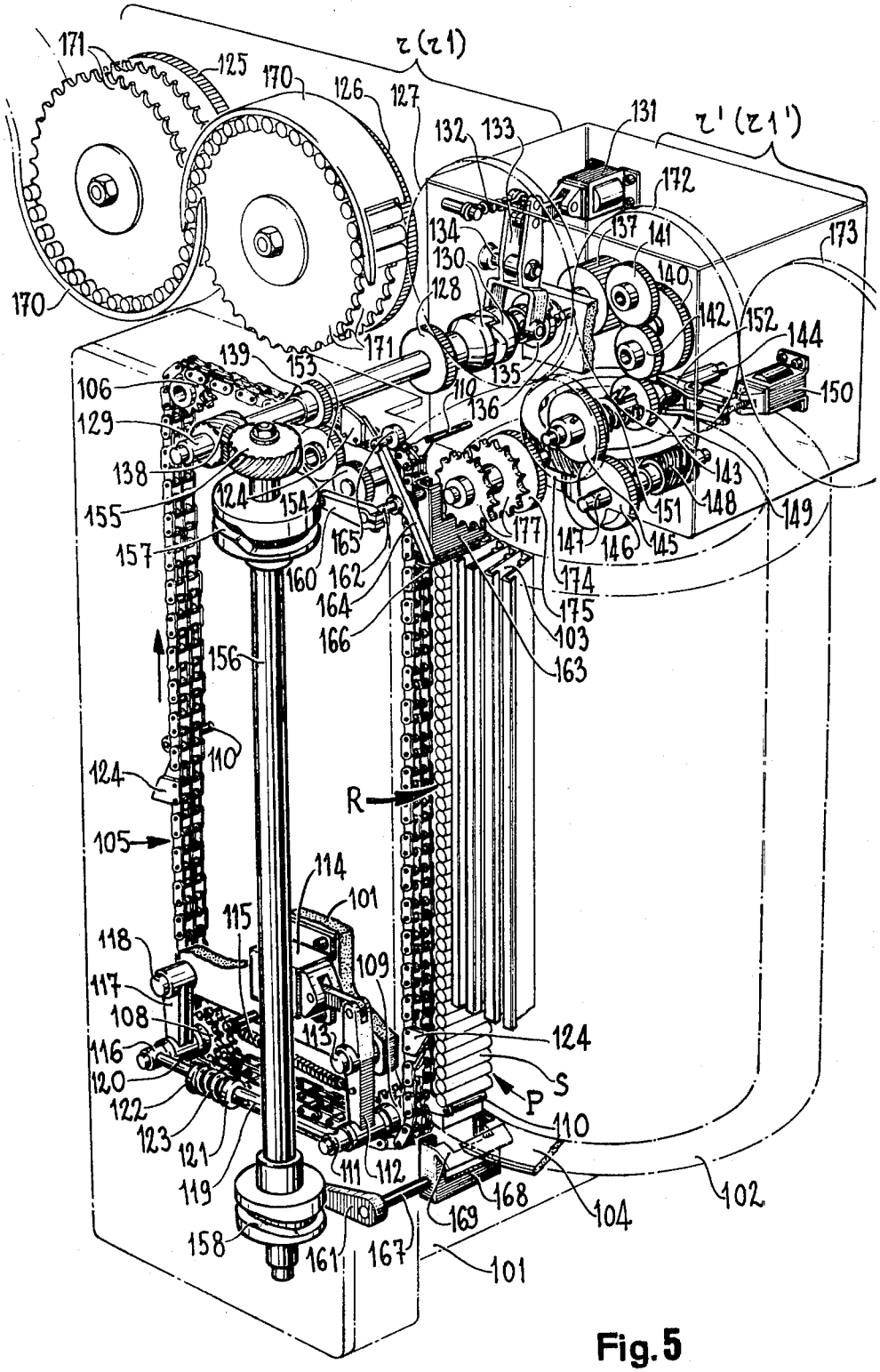
FIG. 5 is a perspective view, with some parts cut away to better show others, of the device according to this invention and drive means thereof.

With particular reference to FIG. 5: the general outline, and also a broken-off portion of a casing of the compensating store device M (M1) according to the invention have been indicated here by the numeral 101. The casing is rigid with the base of the respective cigarette manufacturing machine, not shown here.

A hollow cylindrical body with vertical axis is generally indicated by 102 and has radial, vertical compartments 103, a few of which are shown and which are disposed all around it. They are equally spaced from each other and are about equal in radial depth and in width to the length and width, respectively, of a cigarette. They vertically extend from the top or upper base to the bottom or lower base of the cylindrical body although only part of their extension is shown they are arranged to be receive engaged, as will be explained below, piles P of cigarettes S from the manufacturing machine each pile being one cigarette thick.

The cylindrical body can by a kinematic transmission continuously rotate in either direction of rotation about its own axis so as to bring its compartments 103 successively to a position R. Here the piles P of cigarettes are either stored or they are delivered to the packeting machine I depending on the operative conditions (B, C or D).

Below the cylindrical body 102 and in contact with its lower base there is located a fixed plate 104 arranged to support the piles P of cigarettes and having a gap or interruption at the location of said position R.

A conveyor 105 comprising two chains arranged side by side is endlessly wound about four horizontally aligned pairs 106, 107, 108, 109 of mutually parallel sprocket wheels mounted for a continuous movement in clockwise direction with respect to a viewer of the Figures.

Said sprocket wheels 106, 107, 108 and 109, one of which, as will be explained below, is powered, are horizontally aligned two by two and arranged in such a way that the conveyor 105 extends along the perimeter of a parallelogram, on the right-hand side of which the conveyor section is disposed for a direct movement from above downwards and runs close to said storing and delivering position R.

At regular intervals, three horizontal rods or transfer bars 110 are mounted on one side of conveyor 105, said bars extending to a given extent towards the center of the cylindrical body 102 so as to run along said right-hand side of said parallelogram while being deeply inserted into a compartment 103, at the position R during the storing or delivering operation.

Each rod 110 follows its trajectory without interfering with the side walls of the compartment 103 which, as mentioned above, is in continuous movement; for this purpose the right-hand side of the conveyor 105 is arranged at an inclination which is a function of both the speed of rotation of the cylindrical body 102 and the feed speed of the conveyor 105.

A tubular sleeve 111 is mounted on the axis of the pair of sprocket wheels 109 at the lower end of staring and delivering position R. This sleeve is rigid with the free end of one arm of two-armed lever 112 pivoted on a pin 113 parallel to said axis and the second arm of which is connected to the keeper of an electromagnet 114 rigid with the casing 101.

The action of the electromagnet 114 on said lever 112 is resisted by a spring 115. Owing to such connection, depending upon whether said electromagnet 114 is in an energization or de-energization condition, the wheel 109 takes two different positions symmetric with respect to a vertical line passing through the axis of the wheel 107 at the upper end of position R. Thus the right-hand side of the conveyor 105, next to the position R, can have two different inclinations depending upon whether the cylindrical body 102 rotates in a counterclockwise direction (that is, as will be explained below, in the storing direction) or in clockwise direction (that is, as will be explained below, in the delivery or feeding direction) (see FIGS. 5 to 11).

The second lower pair of sprocket of the wheels 108 on which another tubular sleeve is mounted, is mounted on a rod 117, pivoted on a pin 118 parallel to the pin 113 and rigid with the casing 101.

A horizontal hollow shaft 119 is fixed normal to the tubular sleeve 111. A shaft 120 rigid with the tubular sleeve 116 is coaxially inserted, free to slide to a given extent, into the hollow shaft 119.

Between two discs 121 and 122, which are respectively keyed to the hollow shaft 119 and to the shaft 120, there is located a spring 123, for such resilient connection between the wheels 108 and 109 and to allow the maintenance of the ascending and descending runs or sections of the conveyor 105 parallel to each other in both operating conditions of the device according to the invention. The mounting avoids variations in the chain tension when electromagnet 114 varies the inclination of the conveyor run disposed for movement from above downwards.

At the same distance from each of said three rods 110 and on the opposite side of conveyor 105, there are mounted three cam plates 124 lying in the same plane as that of the conveyor and extending outwards from the perimeter thereof. The profile of each cam plate 124, the function of which will be explained below, has a portion where it ascends from the chain in a direction opposite to the direction of drain's movement.

Rotational movements of portions of the device are derived from a source not shown in the drawings through a succession of gearwheels 125, 126, 127 mounted on axes parallel to each other and normal to the axis of the cylindrical body 102.

A gear 128 idly mounted on a shaft 129 parallel to said axes is rotated by the gearwheel 127.

The aforementioned Kinematic transmission includes a frontal tooth clutch device of a known type which is mounted on shaft 129 and is generally indicated by the numeral 130, one part of said clutch device being rigid with said idle gear 128 and the other part being axially slidable on said shaft 129.

The clutching and declutching operation of said device 130 is controlled by an electromagnet 131 which operates in combination with a spring 132 and is connected to one arm of a two-armed lever 133 pivoted on a horizontal pin 134 normal to the shaft 129 and fixed to the casing 101.

In the energized condition of said electromagnet 131, the second arm of the lever 133 acts on the axially sliding part of the device 130 and causes it to become engaged with the part idly rotating with the gear 128, thereby obtaining rotation of the shaft 129.

In the de-energized condition of the electromagnet 131, the spring 132 by moving the lever 133 in a direction opposite to the previous one disengages the device 130 and thus stops the shaft 129.

A device 135 is mounted on the same shaft 129 and is rigid with the axially slidable part of the device 130. The device 135 has a peripheral groove which, in combination with a fixed pin 136, acts as a blocking element for the shaft 129 during the disengagement or declutching operating.

To the shaft 129 are also keyed (see FIG. 5) a gear 137 at the rear end thereof, and at its front end, helical gear 138 and a spur gear 139.

Gear 137 rotates a gear 140, and a gear 141 meshing with a gear 142.

A gear 143 axially slidable on a shaft 144 parallel to the shaft 129 is rotated by the gear 140 or, alternatively, by the gear 142.

To the shaft 144 is in turn keyed a gear 145 which through a gear 146 rotates a shaft 147 parallel to the shaft 144 and to which there is keyed a helical gear 148 arranged to mesh with the toothed wheel 149 keyed to the axis of the cylindrical body 102. The latter is thus continuously rotated in clockwise direction or in counter-clockwise direction, depending upon whether it is operating in a feeding or delivering stage or in the storing stage.

These directions of rotation are respectively determined by coupling the gear 143 to the gear 140 or, alternatively, the gear 142.

Such operation is carried out by means of an electromagnet 150 rigid with the casing 101 and operating in combination with a spring 151 mounted on the shaft 144 between the two gears 143 and 145.

The electromagnet 150, the keeper of which is connected through a two-armed lever 152 pivoted on a vertical axis to a sleeve rigid with the gear 143, when energized causes said gear 143 to mesh with the gear 142, thereby rotating the cylindrical body 102 in a counter-clockwise direction.

When such electromagnet 150 is in a de-energized condition, the pressing action of the spring 151 causes the gear 143 to mesh with the grear 140, thereby rotating the cylindrical body 102 in clockwise direction.

A gear 154 is keyed to the axis of the pair of sprocket wheels 107 to drive the chain conveyor 105. This gear is rotated by the already-mentioned gear 139 through an idle gear 153.

The already-mentioned helical gear 138 rotates another helical gear 155 rigid with the upper end of a vertical shaft 156 to which two drum cams 157 and 158 are keyed in the order from above downwards. Horizontal idling rollers 159, each carried by one end of an upper lever 160 or a lower lever 161, are arranged to follow the grooves formed in the lateral surfaces of such cams 157 and 158.

The upper lever 160 is pivoted on one end of a pin 162 parallel to the shaft 129 and supported in a manner not visible in the Figure by the casing 101.

A channel 163 which is rectangular in cross-section acts as a connecting element between the cigarette feeding run r″(r1″) and the inlet of the compartments 103 of the cylindrical cigarette storing body 102. Discs 117 of this feeding run are shown in FIGS. 6–11, while the run itself is schematically shown in FIGS. 1–4. Channel 163 is rigidly fixed to the second end of said pin 162 at the position R.

On said pin 162 is also idly pivoted a two-armed lever 164 which has at the free end of one arm an idle roller 165 whose axis is parallel to the pin 162, the roller 165 being arranged to periodically be contact set and raised by profiles of the already-mentioned cam plates 124.

A strip 166 is rigid with the end of the second arm of said lever 164 and is arranged to block the outlet of the channel 163 when the idler roller 165 by the rising profile section of the cam plate 124.

The lower lever 161 is pivoted to one end of a pin 167 parallel to the pin 162 and supported in a way not shown in the Figure by the casing 101.

A channel 168 having a rectangular cross-section acts as a connecting element between the outlet of the cigarette storing compartments 103 and the inlet of the cigarette removing rum r‴ (r1‴) (FIGS. 1–4) having conveyor means 178,179 (FIGS. 6–11). Channel 168 is rigid with the second end of said pin 167 at the position R.

Both said channels 163 and 168 have cuts or notches in thier side walls arranged to allow the rods 110 to pass through without interfering with the side wall. The right-hand side walls of the lower channel 168 also has a lateral extension or flap 169 located flush with the plate 104 for closing its gap or interruption zone.

After the description of the various members forming the device according to the invention and of the respective mechanical actuation or drive means, let us now consider the behaviour of such a device in connection with the various operating modes of the plant of which it is a part, such modes being those previously mentioned under paragraphs A, B, C, D.

In normal operating conditions, mentioned under paragraph A (see FIG. 1), that is when a packeting machine I and the manufacturing machines C and C1 are running, the cigarettes are successively conveyed directly from the outlet of such manufacturing machines C and C1 to the inside of the hopper T through the succession of conveying means *t, r, r'* and *t1, r1, r1'*, respectively.

In such conditions, the electromagnet 131 for each compensating store device M(M1) is not energized and thus the device M associated with the machine C and the device M1 associated with the machine C1 remain dwelling and stationary.

In the remaining operating conditions of said plant, as mentioned under paragraphs B, C, D (see FIGS. 2, 3, 4), the electromagnets 131 for the compensating store devices are energized and are arranged to intervene during the storing stage or, alternatively, in the feeding or delivery stage, as will be explained below.

In the case of a dwell, for any reason whatsoever, of the packeting machine I and of normal operation of one or both the manufacturing machines C and C1 (see FIG. 4), as soon as the cigarettes have reached the predetermined maximum level inside the hopper T, one or both the switching or deviating means located at the position where the run *r* and the runs *r'* and *r''* as well as the run *r1* and the runs *r1'* and *r1''* meet, are actuated by means of a photocell device F, so as to convey the cigarettes from the manufacturing machines C and C1 to the respective compensating store device M or M1.

FIG. 5 schematically shows the end section of run *r* (*r1*) and the initial section of the run *r'*(*r1'*). Between and below these sections, as shown in FIGS. 1–4, is disposed the cigarette feeding run *r''*(*r1''*) to the compensating store device M(M1).

The cigarettes are transferred along said runs by means of a succession of rollers or pairs of coaxial discs mounted on axes all parallel to the shaft 129 and continuously rotating.

The cigarettes extend transversely to their direction of movement, and are located in seats formed all around said rollers or said pairs of discs and are held in a correct position by guides 170.

The drive means for said runs are the same as those described with reference to the cylindrical 102, the motion being transmitted by means of a succession of gearwheels each of which is coaxial to and rigid with one of said rollers or pairs of discs.

As far as the end section of the run *r* (*r1*) is concerned, said gearwheels are those already mentioned and indicated by 125, 126 and 127 and associated with the pairs of discs 171.

The gearwheel 127 rotates in turn the series of gearwheels for the run or section *r'* (*r'1*), two of which, those indicated by 172 and 173, are shown in FIG. 5. Wheel 127 also rotates gearwheels 174 and 175 respectively associated with two pairs of discs 176 and 177 for the run *r''* (*r1''*) which opens into the channel 163, FIGS. 5, 6.

At the location of the discs 171 for the gearwheel 127, there are provided the switching or deviating means formed as disclosed in the already-mentioned Patent Application Ser. No. 651,346 which are arranged according to FIG. 4 of that case to direct the cigarettes from discs 171 of gear 127 of run *r*(*r1*) to either wheel 172 of run *r'*(*r1'*) or to discs 176 of run *r''* (*r1''*) and thereby to the compensating store device M (M1).

Thereupon (as shown in the present FIG. 5), the electromagnet 150 is energized thereby causing the gear 143 and the gear 142 to mesh together by means of the lever 152.

As mentioned above, this results in the rotation in counter-clockwise direction of the cylindrical body 102 which successively transfers empty compartments 103 thereof to the position R, the direction of the heavy arrows shown in FIGS. 6, 7 and 8.

The electromagnet 114 is energized in such a way that, for the above-mentioned reasons, the section of conveyor 105 close to the position R takes an inclination from the left rightwards with respect to a vertical line in the direction of its forward movement, as also shown in FIGS. 6, 7 and 8.

When an empty compartment 103 reaches the position R, shown in FIG. 6 at the left of a filled compartment 103, one of the rods 110 is getting ready to enter in it and at the same time the idle roller 165 runs down along the descending part of the profile of the cam plate 124, thereby removing the strip 166 from the bottom of the channel 163 to open that bottom (FIG. 6).

The cigarettes are then free to fall due to gravity from the end pair of discs 177 of the run *r''* (*r1''*), through said channel 163, into the compartment 103 to form a uniform row which has the rod 110 as a downwardly moving support.

During such operation, the channel 163 continuously varies its inclination by being rotated by the cam 157 about the pin 162 so as to ensure the connection between the disks 177 of the run *r''* (*r1''*) and the mobile compartment 103 at the angular velocity of the cylindrical body 102 while the pile P is being formed.

Once the compartment 103 has been filled, i.e. upon disengagement of the rod 110 from the bottom of this compartment, the idle roller 165 is engaged by the ascending length or section of the profile of a new cam plate 124 so that the strip 166 is inserted into the space between said channel 163 and the inlet of the compartment 103, thereby interrupting the cigarette flow (FIG. 7).

The channel 163 is controlled by the cam 157 to make a rapid backward oscillation movement to the cap of the next empty compartment 103 which has arrived at the position R, whereas the strip 166 at the end of the stroke of the roller 165 along the ascending length of the plate 124 moves away from the outlet of the channel 163 (FIG. 8).

In the case of stopping of one or both manufacturing machines C and C1 (see FIG. 2 or FIG. 3), the feeding continuity of the cigarettes to the respective conveyors *r, r'* and/or *r1, r1'* is ensured by the compensating store devices M and M1.

In such conditions, for instance with reference to the device M, the electromagnet 150 to de-energized and under the pressing action of the spring 151 the gear 143 and the gear 140 are caused to mesh with one another.

This results, as already mentioned above, in the rotation in the clockwise direction of the cylindrical body 102 and thus in the transfer of the compartments 103 full of cigarettes to the position R (see FIGS. 9, 10, 11).

A de-energizing control is also applied to the electromagnet 114 so that, always in view of what has been described above, the section of conveyor 105 close to the position R takes, in the direction of its movement, an inclination from the right leftwards with respect to a vertical line.

Each pile P of cigarettes S no longer supported at the position R by the plate 104 enters the inlet of the channel 168 which is then vertically arranged below the cylindrical body 102.

During the ensuing operation, similarly to what has been described above, the channel 168 upon control from the cam 158, varies its inclination by rotating about the pin 167 (FIG. 5) so as to ensure throughout the duration of the descent of the pile P the connection between the mobile compartment 103 at the angular speed of the cylindrical body 102 and the run *r'''* (*r*1'''') comprising for instance a continuous conveyor 178 endlessly wound about wheels 179 and having grooves transverse to its direction of movement.

The already-mentioned edge 169 on the right-hand side walls of the channel 168 is arranged to support the next pile P of cigarettes already arrived at the location of the gap or interruption zone of the plate 104 and waiting for the channel 168 to return, upon control of the cam 158, with a rapid backward oscillation, into the vertical connection position between a new compartment 103 full of cigarettes and the run *r'''* (*r*1''').

Obviously, the above-described embodiment of the compensating store device has been given only by way of example and it should be understood that the cylindrical body comprising radial compartments can be provided with a unidirectional movement for storing and respectively feeding stages by means of simple and obvious expedients, so as to avoid a long dwelling of piles of cigarettes within the store.

I claim:

1. Apparatus for compensating unbalances in operations of machines for producing and packeting cigarettes, comprising;

a compensating store cylinder having means for continously rotating it about a vertical axis and having vertically and radially extending cigarette-storing compartments distributed about the cylinder's circumference, each compartment having a generally open top and a generally open bottom and being dimensioned to permit horizontally disposed cigarettes in a cigarette pile one cigarette thick to be disposed in the compartment and slidingly to be moved downwardly along the same;

cigarette support means selectively actuatable for enabling such a pile to be disposed in each compartment and slidingly to be moved downwardly along the same;

a conveyor system including a cigarette-feeding conveyor, for feeding a stream of individual cigarettes to a fixed location at the top of the cylinder from a cigarette-producing machine for discharge into the top of one of the compartments during a first type of unbalance between operations of the producing machine and of a cigarette packeting machine, and a cigarette-withdrawing conveyor for withdrawing a stream of individual cigarettes from the bottom of the compartment to a fixed location at the bottom of the cylinder and further to the packeting machine during a second type of unbalance between such operations;

means for controlling the conveyor system and for actuating the cigarette support means in response to either type of unbalance; and transfer channel means for selectively delivering cigarettes from the feeding conveyor into successive ones of the compartments and for discharging cigarettes therefrom to the withdrawing conveyor, comprising two transfer channels, each tiltably mounted at one of said fixed locations, each channel having a cigarette transfer section disposed to be moved with and relative to the cylinder during the cylinder's rotation and to provide an open path for cigarettes smoothly sliding between the section and one of the compartments, for a predetermined time, and thereafter to establish similar communication between the section and a next following one of the compartments, and means for gradually tilting the channels to effect the moving of their respective transfer sections with the cylinder, and thereby to insure the smooth sliding of the cigarettes when the cigarette support means are actuated.

2. Apparatus according to claim 1 in which the cigarette support means comprise spaced-apart horizontal rods, and means for moving one of the rods downwardly into, through and from each successive one of the compartments, enabling a corresponding cigarette pile to perform the sliding downward movement thereof.

3. Apparatus according to claim 2 including conveyor chain means for supporting and moving the rod while holding it in a position normal to the vertical axis.

4. Apparatus according to claim 3 in which the conveyor chain means have a descending run opposite the compensation store cylinder, and means for holding the descending run with an inclination relative to a vertical line and for thereby enabling the rods to move down through each compartment and at the same time to move horizontally with the rotating cylinder, to avoid interfering with the rotation and with the sliding downward movement of the cigarettes.

5. Apparatus according to claim 4 additionally including means for reversing the inclination of the descending run to enable the conveyor chain means to operate upon a reversal of the rotating of the cylinder.

6. Apparatus according to claim 1 including means for reversing the rotating of the cylinder to enable the cigarette support means and the conveyor system, prior to the reversing, to feed cigarettes through the channel means at the top to the store cylinder, and after the reversing to withdraw cigarettes through the channel means at the bottom from the store cylinder, while avoiding interference of the cigarette support means with the cigarette-storing compartments and with sliding movement of the cigarettes along the same.

7. Apparatus according to claim 1 in which the means for gradually tilting the channels comprises cam means driven by the means for continuously rotating the cylinder, and two cam followers controlled by the cam means, each connected with one of the cigarette transfer sections.

8. Apparatus according to claim 7 in which the cam means comprises a first cam disposed adjacent one of said fixed locations; a second cam disposed adjacent the other of said fixed locations; and a shaft drivable by the means for rotating the cylinder for driving the first and second cams.

9. Apparatus according to claim 7 in which the cam means has a gradually inclined cam - way for effecting, through the cam followers, the gradual tilting of the channels, and a steeply inclined cam - way communicating with the gradually inclined one for rapidly performing the establishing of communication between the channel section and a next following one of the compartments.

10. A compensating storage unit for compensating operating unbalances of manufacturing and packeting machines in a plant for producing cigarette packets, which plant comprises a system for directly feeding a stream of individual cigarettes disposed transversely of the stream by conveyor means continuously unidirectionally movable from at least one cigarette manufacturing machine to a machine for packeting the manufactured cigarettes, the unit comprising;

a cylindrical body having its cylinder axis vertically disposed and having radially extending cigarette-storing compartments parallel to said vertical axis, each compartment having an open top and an open bottom and being dimensioned to permit cigarettes to be horizontally disposed in a cigarette pile one cigarette thick in the compartment between the top and the bottom an upper cigarette infeeding channel and a lower cigarette withdrawing channel respectively positioned above and below said cylindrical body in the area thereof including said open tops and bottoms of said compartments, said upper infeeding and lower withdrawing channels being vertically aligned one relative to the other, a movable device having uniformly spaced apart rigid cantilever rods to take successive ones of said rods, perpendicularly to the vertical axis of the cylindrical body, into and along one of the radially disposed cigarette-storing compartments which is in vertical alignment with and between said upper infeeding and lower withdrawing channels, and intercepting means for stopping a stream of individual cigarettes, along said upper infeeding and lower withdrawing channels, relative to the open top and open bottom of said one cigarette-storing compartment, in synchronism with transitions of individual successive cigarette-storing compartments between said upper and infeeding and lower withdrawing channels;

a kinematic movement transmission connected to said cylindrical body and to said movable device to transmit a continuous bidirectional movement to said cylindrical body rotating about its vertical axis for the disposing of cigarettes in each compartment during movement in one direction and for withdrawing them therefrom during movement in the opposite direction, and to transmit a continuous unidirectional movement to said movable device and cantilever rods;

clutch means in said kinematic transmission upstream of said cylindrical body and said movable device;

control means for deriving the bidirectional movement from the unidirectional movement, the control means being connected to the kinematic transmission between said clutch means and said cylindrical body; and movable sections of said upper infeeding and lower withdrawing channels, said movable sections being combined with said intercepting means and being actuated by said kinematic movement transmission in synchronism with completion of cigarette-storing and withdrawing phases in a cigarette-storing compartment and with inception of such phases in a successive-cigarette-storing compartment, the clutch means and the control means being controlled by the manufacturing and packeting machines.

* * * * *